US009856885B2

(12) United States Patent
Hasegawa et al.

(10) Patent No.: US 9,856,885 B2
(45) Date of Patent: Jan. 2, 2018

(54) OIL TANK OF TURBO CHILLER COMPRESSOR AND TURBO CHILLER COMPRESSOR

(71) Applicant: MITSUBISHI HEAVY INDUSTRIES THERMAL SYSTEMS, LTD., Tokyo (JP)

(72) Inventors: Yasushi Hasegawa, Tokyo (JP); Kenji Ueda, Tokyo (JP); Masataka Yanagita, Tokyo (JP); Masayoshi Mikuriya, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 82 days.

(21) Appl. No.: 14/768,326

(22) PCT Filed: Feb. 13, 2014

(86) PCT No.: PCT/JP2014/053255
§ 371 (c)(1),
(2) Date: Aug. 17, 2015

(87) PCT Pub. No.: WO2014/136540
PCT Pub. Date: Sep. 12, 2014

(65) Prior Publication Data

US 2016/0010654 A1 Jan. 14, 2016

(30) Foreign Application Priority Data

Mar. 6, 2013 (JP) ..... 2013-044010

(51) Int. Cl.
*F04D 29/063* (2006.01)
*F25B 1/053* (2006.01)
(Continued)

(52) U.S. Cl.
CPC ..... *F04D 29/063* (2013.01); *F04D 29/4206* (2013.01); *F04D 29/584* (2013.01);
(Continued)

(58) Field of Classification Search
CPC .... F04D 29/063; F04D 29/4206; F25B 1/053; F25B 2500/16
See application file for complete search history.

(56) References Cited

U.S. PATENT DOCUMENTS 3,235,032 A * 2/1966 Lovercheck ..... F01M 5/021 184/104.2
3,251,537 A * 5/1966 Bancroft ..... F04F 9/00 392/394

(Continued)

FOREIGN PATENT DOCUMENTS

CN 201137571 Y 10/2008
JP 57-170296 U 10/1982

(Continued)

OTHER PUBLICATIONS

Singaporean Search Report and Written Opinion for Singaporean Application No. 11201506716Y, dated Jun. 23, 2016.

(Continued)

*Primary Examiner* — William E Dondero
*Assistant Examiner* — Mark K Buse
(74) *Attorney, Agent, or Firm* — Birch, Stewart, Kolasch & Birch, LLP

(57) ABSTRACT

Provided is an oil tank of a turbo chiller compressor whose heater can be replaced or checked without removing oil from an oil tank and removing refrigerant from a turbo chiller, and a turbo chiller compressor. An oil tank (10) of a turbo chiller compressor (3A) includes a bottom plate (11) and side plates (12, 13) standing upright so as to extend upward from an outer peripheral edge portion of the bottom plate (11). The oil tank (10) forms a bottom portion of a casing (14) forming the turbo chiller compressor (3A), a through-hole (21) is (Continued)

formed so as to penetrate the side plate (12) in a plate thickness direction, a protective tube (22) closed at a tip end thereof is inserted into the through-hole (21), and a rod-shaped heater (26) configured to be able to be pulled out from the protective tube (22) and be inserted into the protective tube (22) is inserted into the protective tube (22).

4 Claims, 4 Drawing Sheets

(51) Int. Cl.
*F04D 29/42* (2006.01)
*F25B 31/00* (2006.01)
*F04D 29/58* (2006.01)

(52) U.S. Cl.
CPC ..... *F25B 1/053* (2013.01); *F25B 31/002* (2013.01); *F25B 2500/16* (2013.01)

(56) References Cited

U.S. PATENT DOCUMENTS 4,066,869 A * 1/1978 Apaloo ..... F04B 39/0207 184/104.1
4,755,657 A * 7/1988 Crim ..... F04B 39/0207 219/536
7,059,839 B2 * 6/2006 Haller ..... F01C 21/10 184/6.16
2011/0016916 A1 * 1/2011 Tsukamoto ..... F04D 29/063 62/498

FOREIGN PATENT DOCUMENTS

| | | | |
|---|---|---|---|
| JP | 59-187798 | U | 12/1984 |
| JP | 61-166193 | U | 10/1986 |
| JP | 62-96791 | A | 5/1987 |
| JP | 4-42560 | Y2 | 10/1992 |
| JP | 2000-230494 | A | 8/2000 |
| JP | 2011-26958 | A | 2/2011 |
| WO | 00/17586 | A1 | 3/2000 |

OTHER PUBLICATIONS

Japanese Office Action and English translation dated Jan. 31, 2017 for Application No. 2013-044010.

* cited by examiner

OIL TANK OF TURBO CHILLER COMPRESSOR AND TURBO CHILLER COMPRESSOR

TECHNICAL FIELD

The present invention relates to an oil tank of a turbo chiller compressor and to a turbo chiller compressor.

BACKGROUND ART

Examples of an oil tank of a turbo chiller compressor include an oil tank 13 including a heater 30 as illustrated in FIG. 2 of PTL 1, and an oil tank chamber 2 including an oil heater 6 as illustrated in FIGS. 1(A) and 2(A) of PTL 2.

CITATION LIST

Patent Literature

{PTL 1}
Japanese Unexamined Patent Application, Publication No. 2011-26958
{PTL 2}
Japanese Examined Utility Model Application, Publication No. Hei 4-42560

SUMMARY OF INVENTION

Technical Problem

However, in the oil tank 13 including the heater 30 as described in PTL 1 and the oil tank chamber 2 including the oil heater 6 as described in PTL 2, when the heater 30 or the oil heater 6 needs to be replaced due to a trouble thereof, the heater 30 or the oil heater 6 needs to be replaced after all of oil in the oil tank 13 or the oil tank chamber 2 and refrigerant in a turbo chiller are removed.

The present invention has been made to solve the above-described problem, and is intended to provide an oil tank of a turbo chiller compressor whose heater can be replaced or checked without removing oil from the oil tank and removing refrigerant from a turbo chiller and to provide a turbo chiller compressor.

Solution to Problem

In order to solve the above-described problem, the present invention employs the following solutions.

A first aspect of the present invention is intended for an oil tank of a turbo chiller compressor, including a bottom plate, and a side plate standing upright so as to extend upward from an outer peripheral edge portion of the bottom plate. The oil tank forms a bottom portion of a casing forming the turbo chiller compressor, a through-hole is formed so as to penetrate the side plate in a plate thickness direction, a protective tube closed at a tip end thereof is inserted into the through-hole, and a rod-shaped heater configured to be able to be pulled out from the protective tube and be inserted into the protective tube is inserted into the protective tube.

According to this configuration, the heater is replaced or checked only by pulling out of the heater from the protective tube and insertion of the heater into the protective tube. That is, the heater is replaced or checked in the state in which the protective tube remains fixed to the side plate forming the oil tank.

Thus, the heater can be replaced or checked without removing oil from the oil tank and removing refrigerant from a turbo chiller.

In the first aspect, the through-hole is more preferably formed at a bottommost portion of the side plate.

According to this configuration, convection of oil heated by the heater can be promoted, and therefore, oil in the oil tank can be efficiently heated.

In the first aspect, a space between the protective tube and the heater is more preferably filled with heat transfer fluid having a high coefficient of thermal conductivity.

According to this configuration, the coefficient of thermal conductivity from the heater to the protective tube can be increased, and therefore, a low-power heater can be employed.

A second aspect of the present invention is intended for an oil tank of a turbo chiller compressor, including a bottom plate, and a side plate standing upright so as to extend upward from an outer peripheral edge portion of the bottom plate. The oil tank forms a bottom portion of a casing forming the turbo chiller compressor, in the bottom plate, a hole is formed so as to extend from one end surface of the bottom plate toward the other end surface of the bottom plate opposite to the one end surface, and a rod-shaped heater configured to be able to be pulled out from the hole and be inserted into the hole is inserted into the hole.

According to this configuration, the heater is replaced or checked only by pulling out of the heater from the hole formed inside the bottom plate and insertion of the heater into the hole.

Thus, the heater can be replaced or checked without removing oil from the oil tank and removing refrigerant from a turbo chiller.

In the second aspect, a space between the hole and the heater is more preferably filled with heat transfer fluid 88 having a high coefficient of thermal conductivity.

According to this configuration, the coefficient of thermal conductivity from the heater to the bottom plate can be increased, and therefore, a low-power heater can be employed.

A third aspect of the present invention is intended for an oil tank of a turbo chiller compressor, including a bottom plate, and a side plate standing upright so as to extend upward from an outer peripheral edge portion of the bottom plate. The oil tank forms a bottom portion of a casing forming the turbo chiller compressor, and a sheet-shaped heater is attached so as to cover an outer surface of the bottom plate or cover outer surfaces of the bottom and side plates.

According to this configuration, the heater is replaced or checked only by detachment and attachment of the heater attached to the outer surface of the bottom plate or the outer surfaces of the bottom and side plates.

Thus, the heater can be replaced or checked without removing oil from the oil tank and removing refrigerant from a turbo chiller.

In the third aspect, sheet-shaped metal having a high coefficient of thermal conductivity is more preferably interposed between the heater and the outer surface so as to closely adhere to both of the heater and the outer surface.

According to this configuration, the coefficient of thermal conductivity from the heater to an outer surface of the oil tank can be increased, and therefore, a low-power heater can be employed.

In the above-described aspects, a plurality of heat transfer fins are more preferably formed so as to protrude upward from an upper surface of the bottom plate.

According to this configuration, the contact area between oil and the bottom plate heated by the heater can be increased. Thus, oil can be more efficiently heated, and as a result, a lower-power heater can be employed.

A fourth aspect of the present invention is intended for a turbo chiller compressor including the oil tank of a turbo chiller compressor of any one of the above-described aspects.

According to this configuration, the heater attached to the oil tank can be replaced or checked without removing oil from the oil tank and removing refrigerant from a turbo chiller.

Moreover, according to this configuration, since the heater attached to the oil tank can be replaced or checked without removing oil from the oil tank and removing refrigerant from the turbo chiller, a working time required for replacement or checking of the heater can be significantly reduced, and therefore, the operation rate and reliability of the turbo chiller compressor can be improved.

A fifth aspect of the present invention is intended for a turbo chiller including the turbo chiller compressor described above.

According to this configuration, a working time required for replacement or checking of the heater attached to the oil tank of the turbo chiller compressor can be significantly reduced, and therefore, the operation rate and reliability of the turbo chiller can be improved.

Advantageous Effects of Invention

According to the oil tank of the turbo chiller compressor and the turbo chiller compressor of the present invention, there is an advantageous effect that the heater can be replaced or checked without removing oil from the oil tank and removing refrigerant from the turbo chiller.

DESCRIPTION OF EMBODIMENTS

{First Embodiment}

An oil tank of a turbo chiller compressor of a first embodiment of the present invention, a turbo chiller compressor including the oil tank of the turbo chiller compressor of the first embodiment of the present invention, and a turbo chiller including the turbo chiller compressor of the first embodiment of the present invention will be described below with reference to FIG. 1.

Figure 1:
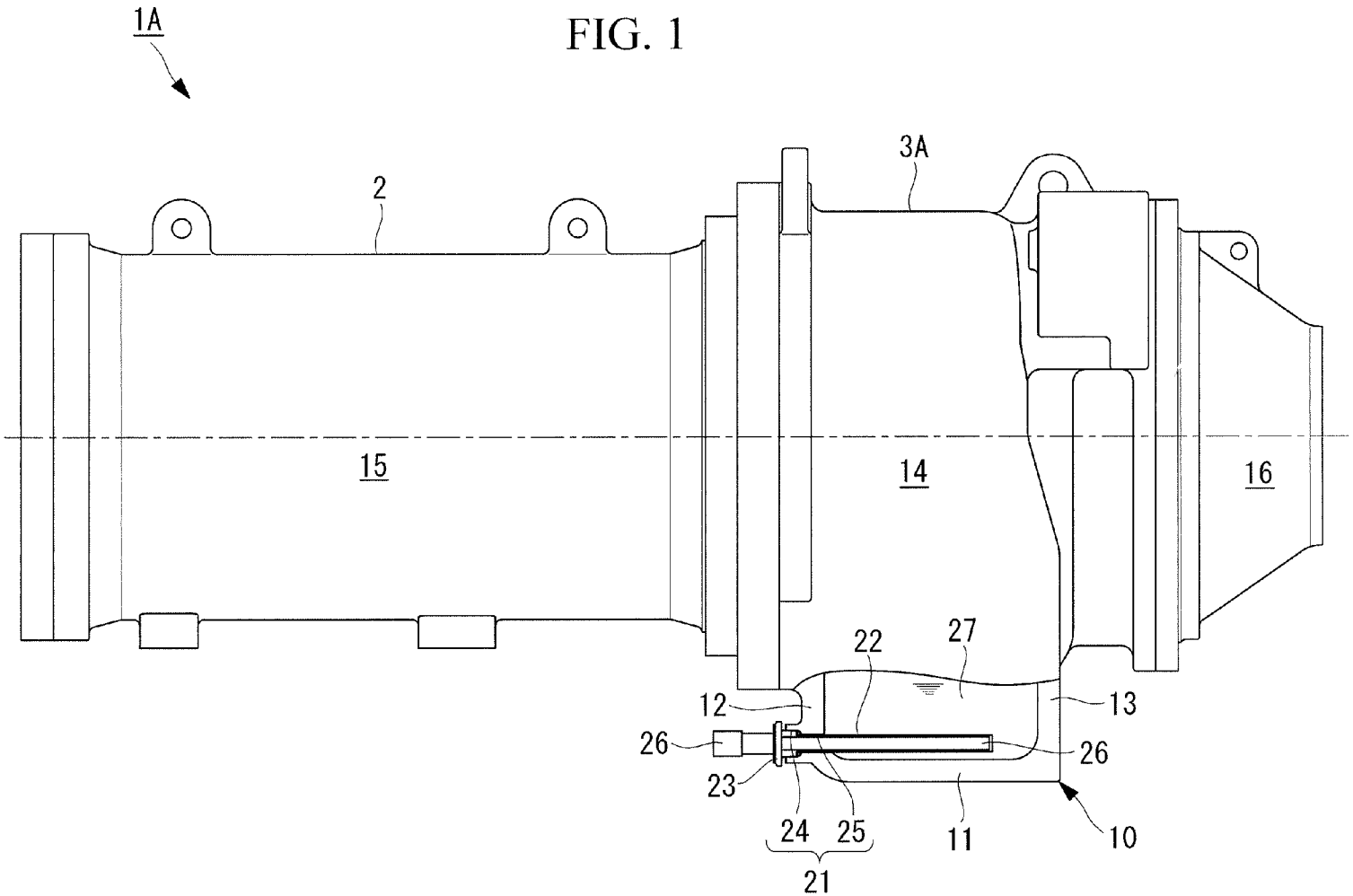
FIG. 1 is a partial cross-sectional view illustrating an oil tank of a turbo chiller compressor according to a first embodiment of the present invention.

As illustrated in FIG. 1, a turbo chiller 1A of the present embodiment is, for example, placed at a building or a factory in order to generate coolant water for adjusting air. The turbo chiller 1A includes a turbo chiller compressor (a turbo compressor) 3A rotatably driven by an electric motor 2 to compress refrigerant vapor into high-pressure vapor, an evaporator (not shown) configured to evaporate chilled water, a condenser (not shown) configured to cool high-pressure vapor with coolant water to condense the high-pressure vapor, and an expander (not shown) configured to expand, by reducing the pressure of condensed refrigerant, the condensed refrigerant to send the expanded refrigerant to the evaporator. The turbo chiller compressor 3A, the evaporator, the condenser, and the expander are connected together with refrigerant pipes (not shown) through which refrigerant circulates.

An oil tank 10 of the turbo chiller compressor 3A includes a bottom plate 11, a (first) side plate 12, a (second) side plate 13, a (third) side plate (not shown), and a (fourth) side plate (not shown), these side plates standing upright so as to extend upward from an outer peripheral edge portion of the bottom plate 11. These bottom and side plates form a bottom portion (a lower portion) of a (first) casing 14 (in the present embodiment, a compressor casing forming the turbo chiller compressor 3A).

The bottom plate 11 is a plate-shaped member extending in an axial direction and a right-left direction and having a rectangular shape as viewed in the plane.

The side plate 12 is a plate-shaped member positioned on a side close to a (second) casing 15 (in the present embodiment, a motor casing forming the electric motor 2) attached to one end of the casing 14 and extending in the vertical direction.

The side plate 13 is a plate-shaped member positioned on a side close to a (third) casing 16 (in the present embodiment, a compressor inlet casing forming an inlet of the turbo chiller compressor 3A) attached to the other end of the casing 14 and extending in the vertical direction.

A through-hole 21 is formed so as to penetrate, in a plate thickness direction, through a bottom portion (a lower portion) of the side plate 12, and more preferably a bottom-most portion (a lowermost portion) of the side plate 12.

The through-hole 21 is formed with a (first) through-hole 24 which is positioned on the near side (the outside) of the side plate 12 and which receives an external thread portion of a screw joint 23 provided at a base end portion of a protective tube 22 and a (second) through-hole 25 which is positioned on the far side (the inside) of the side plate 12 and into which the protective tube 22 is inserted.

An internal thread portion which comes into engagement with the external thread portion formed at an outer peripheral surface of the screw joint 23 is formed at an inner peripheral surface of the through-hole 24.

A heater 26 is inserted into the protective tube 22, and a space between the protective tube 22 and the heater 26 is filled with heat transfer fluid 88 (e.g., a heat-resistant release silicon material, chemically-synthesized oil, and a boron nitride aqueous solution) having a high coefficient of thermal conductivity (having excellent thermal conductivity).

Note that a reference numeral "27" in FIG. 1 denotes oil (lubrication oil).

According to the oil tank 10 of the turbo chiller compressor 3A of the present embodiment, i.e., the oil tank 10 of the turbo chiller compressor 3A including the heater 26, the heater 26 is replaced or checked only by pulling out of the heater 26 from the protective tube 22 and insertion of the heater 26 into the protective tube 22. That is, the heater 26 is replaced or checked in the state in which the protective tube 22 remains fixed to the side plate 12 forming the oil tank 10.

Thus, the heater 26 can be replaced or checked without removing the oil 27 from the oil tank 10 and removing refrigerant from the turbo chiller 1A.

Moreover, according to the oil tank 10 of the turbo chiller compressor 3A of the present embodiment, i.e., the oil tank 10 of the turbo chiller compressor 3A including the heater 26, the through-hole 21 is formed at the bottommost portion of the side plate 12. Thus, convection of the oil 27 heated by the heater 26 can be promoted, and therefore, the oil 27 in the oil tank 10 can be efficiently heated.

Further, according to the oil tank 10 of the turbo chiller compressor 3A of the present embodiment, i.e., the oil tank 10 of the turbo chiller compressor 3A including the heater 26, the space between the protective tube 22 and the heater 26 is filled with the heat transfer fluid 88 having a high coefficient of thermal conductivity. Thus, the coefficient of thermal conductivity from the heater 26 to the protective tube 22 can be increased, and therefore, a low-power heater can be employed.

According to the turbo chiller compressor 3A of the present embodiment, the heater 26 attached to the oil tank 10 can be replaced or checked without removing the oil 27 from the oil tank 10 and removing refrigerant from the turbo chiller 1A.

Moreover, according to the turbo chiller compressor 3A of the present embodiment, since the heater 26 attached to the oil tank 10 can be replaced or checked without removing the oil 27 from the oil tank 10 and removing refrigerant from the turbo chiller 1A, a working time required for replacement or checking of the heater 26 can be significantly reduced, and therefore, the operation rate and reliability of the turbo chiller compressor 3A can be improved.

In the turbo chiller 1A of the present embodiment, the working time required for replacement or checking of the heater 26 attached to the oil tank 10 of the turbo chiller compressor 3A is significantly reduced. Thus, the operation rate and reliability of the turbo chiller 1A can be improved.

{Second Embodiment}

An oil tank of a turbo chiller compressor of a second embodiment of the present invention, a turbo chiller compressor including the oil tank of the turbo chiller compressor of the second embodiment of the present invention, and a turbo chiller including the turbo chiller compressor of the second embodiment of the present invention will be described below with reference to FIG. 2.

Figure 2:
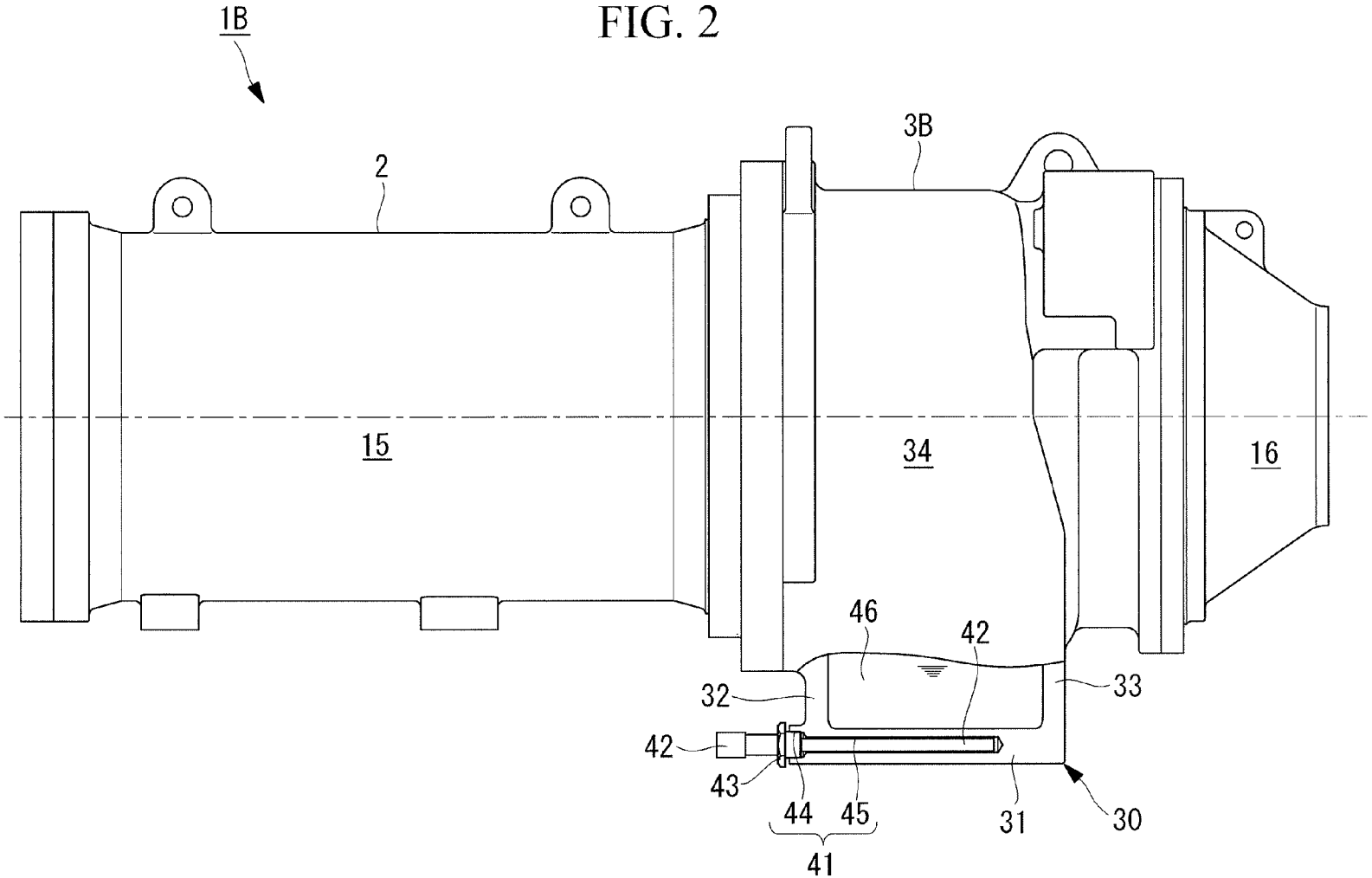
FIG. 2 is a partial cross-sectional view illustrating an oil tank of a turbo chiller compressor according to a second embodiment of the present invention.

As illustrated in FIG. 2, a turbo chiller 1B of the present embodiment is, for example, placed at a building or a factory in order to generate coolant water for adjusting air. The turbo chiller 1B includes a turbo chiller compressor (a turbo compressor) 3B rotatably driven by an electric motor 2 to compress refrigerant vapor into high-pressure vapor, an evaporator (not shown) configured to evaporate chilled water, a condenser (not shown) configured to cool high-pressure vapor with coolant water to condense the high-pressure vapor, and an expander (not shown) configured to expand, by reducing the pressure of condensed refrigerant, the condensed refrigerant to send the expanded refrigerant to the evaporator. The turbo chiller compressor 3B, the evaporator, the condenser, and the expander are connected together with refrigerant pipes (not shown) through which refrigerant circulates.

As illustrated in FIG. 2, an oil tank 30 of the turbo chiller compressor 3B of the present embodiment includes a bottom plate 31, a (first) side plate 32, a (second) side plate 33, a (third) side plate (not shown), and a (fourth) side plate (not shown), these side plates standing upright so as to extend upward from an outer peripheral edge portion of the bottom plate 31. These bottom and side plates form a bottom portion (a lower portion) of a (first) casing 34 (in the present embodiment, a compressor casing forming the turbo compressor 3B).

The bottom plate 31 is a plate-shaped member extending in an axial direction and a right-left direction and having a rectangular shape as viewed in the plane.

The side plate 32 is a plate-shaped member positioned on a side close to a (second) casing 15 (in the present embodiment, a motor casing forming the electric motor 2) attached to one end of the casing 34 and extending in the vertical direction.

The side plate 33 is a plate-shaped member positioned on a side close to a (third) casing 16 (in the present embodiment, a compressor inlet casing forming an inlet of the turbo compressor 3B) attached to the other end of the casing 34 and extending in the vertical direction.

In the bottom plate 31, a hole 41 is formed so as to extend, in the axial direction, from a vertically-extending end surface of the bottom plate 31 positioned on the side close to the casing 15 toward a vertically-extending end surface of the bottom plate 31 positioned on the side close to the casing 16.

The hole 41 is formed with a (first) hole 44 which is positioned on the near side (the side close to the casing 15) of the bottom plate 31 and which receives an external thread portion of a screw joint 43 provided at a base end portion of a rod-shaped (electric) heater (a heating means) 42 and a (second) hole 45 which is positioned on the far side (the far side of the hole 44) of the bottom plate 31 and into which the heater 42 is inserted.

An internal thread portion which comes into engagement with the external thread portion formed at an outer peripheral surface of the screw joint 43 is formed at an inner peripheral surface of the hole 44.

A heater 42 is inserted into the hole 41, and a space between the hole 41 and the heater 42 is filled with heat transfer fluid 88 (e.g., a heat-resistant release silicon material, chemically-synthesized oil, and a boron nitride aqueous solution) having a high coefficient of thermal conductivity (having excellent thermal conductivity).

Note that a reference numeral "46" in FIG. 2 denotes oil(lubrication oil).

According to the oil tank 30 of the turbo chiller compressor 3B of the present embodiment, i.e., the oil tank 30 of the turbo chiller compressor 3B including the heater 42, the heater 42 is replaced or checked only by pulling out of the heater 42 from the hole 41 formed inside the bottom plate 31 and insertion of the heater 42 into the hole 41.

Thus, the heater 42 can be replaced or checked without removing the oil 46 from the oil tank 30 and removing refrigerant from the turbo chiller 1B.

Moreover, according to the oil tank 30 of the turbo chiller compressor 3B of the present embodiment, i.e., the oil tank 30 of the turbo chiller compressor 3B including the heater 42, the space between the hole 41 and the heater 42 is filled with the heat transfer fluid 88 having a high coefficient of thermal conductivity. Thus, the coefficient of thermal conductivity from the heater 42 to the bottom plate 31 can be increased, and therefore, a low-power heater can be employed.

According to the turbo chiller compressor 3B of the present embodiment, the heater 42 attached to the oil tank 30 can be replaced or checked without removing the oil 46 from the oil tank 30 and removing refrigerant from the turbo chiller 1B.

Moreover, according to the turbo chiller compressor 3B of the present embodiment, since the heater 42 attached to the oil tank 30 can be replaced or checked without removing the oil 46 from the oil tank 30 and removing refrigerant from the turbo chiller 1B, a working time required for replacement or checking of the heater 42 can be significantly reduced, and therefore, the operation rate and reliability of the turbo chiller compressor 3B can be improved.

In the turbo chiller 1B of the present embodiment, the working time required for replacement or checking of the heater 42 attached to the oil tank 30 of the turbo chiller compressor 3B is significantly reduced. Thus, the operation rate and reliability of the turbo chiller 1B can be improved.

{Third Embodiment}

An oil tank of a turbo chiller compressor of a third embodiment of the present invention, a turbo chiller compressor including the oil tank of the turbo chiller compressor of the third embodiment of the present invention, and a turbo chiller including the turbo chiller compressor of the third embodiment of the present invention will be described below with reference to FIG. 3.

Figure 3:
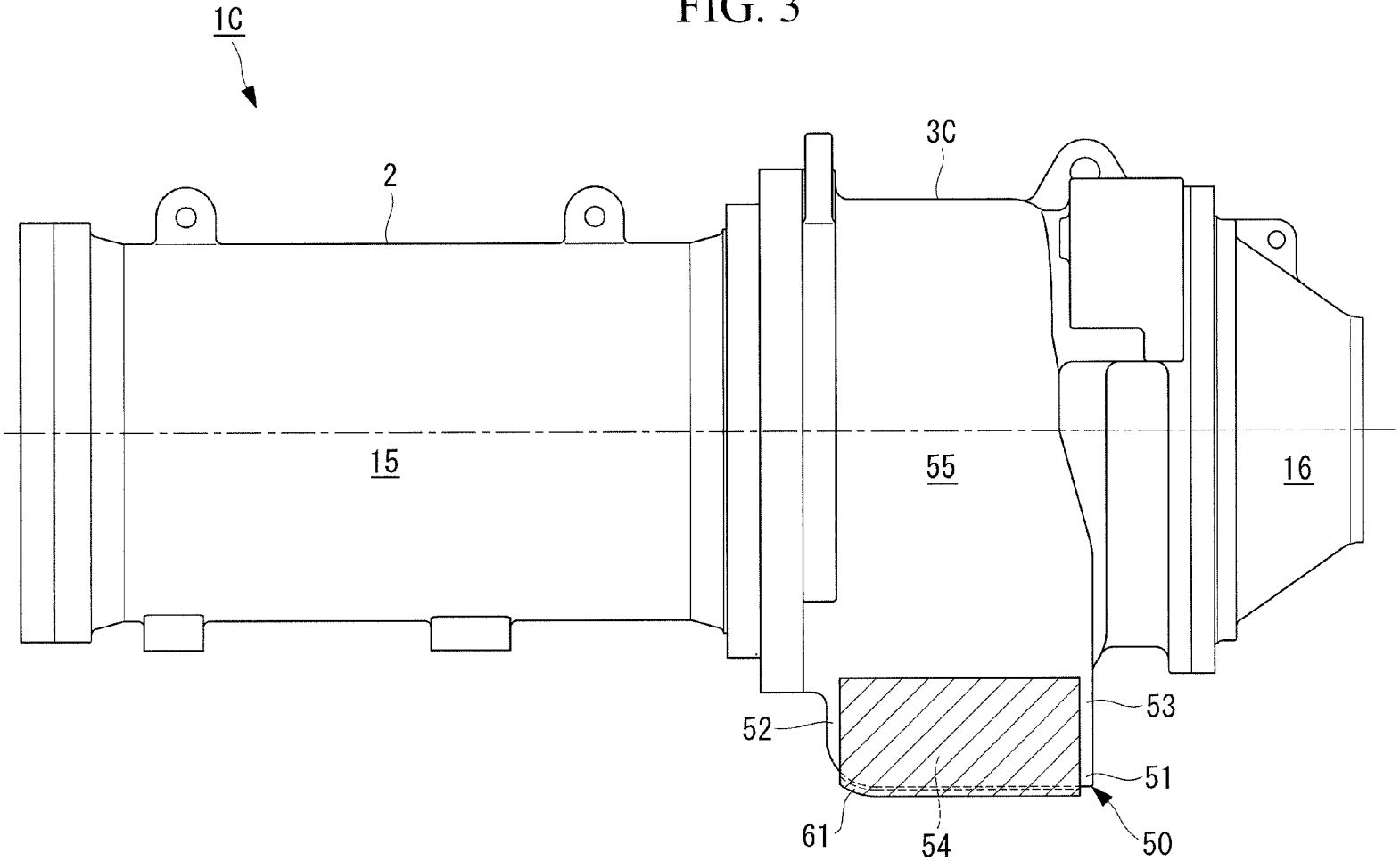
FIG. 3 is a partial cross-sectional view illustrating an oil tank of a turbo chiller compressor according to a third embodiment of the present invention.

As illustrated in FIG. 3, a turbo chiller 1C of the present embodiment is, for example, placed at a building or a factory in order to generate coolant water for adjusting air. The turbo chiller 1C includes a turbo chiller compressor (a turbo compressor) 3C rotatably driven by an electric motor 2 to compress refrigerant vapor into high-pressure vapor, an evaporator (not shown) configured to evaporate chilled water, a condenser (not shown) configured to cool high-pressure vapor with coolant water to condense the high-pressure vapor, and an expander (not shown) configured to expand, by reducing the pressure of condensed refrigerant, the condensed refrigerant to send the expanded refrigerant to the evaporator. The turbo chiller compressor 3C, the evaporator, the condenser, and the expander are connected together with refrigerant pipes (not shown) through which refrigerant circulates.

As illustrated in FIG. 3, an oil tank 50 of the turbo chiller compressor 3C of the present embodiment includes a bottom plate 51, a (first) side plate 52, a (second) side plate 53, a (third) side plate 54, and a (fourth) side plate (not shown), these side plates standing upright so as to extend upward from an outer peripheral edge portion of the bottom plate 51. These bottom and side plates form a bottom portion (a lower portion) of a (first) casing 55 (in the present embodiment, a compressor casing forming the turbo chiller compressor 3C).

The bottom plate 51 is a plate-shaped member extending in an axial direction and a right-left direction and having a rectangular shape as viewed in the plane.

The side plate 52 is a plate-shaped member positioned on a side close to a (second) casing 15 (in the present embodiment, a motor casing forming the electric motor 2) attached to one end of the casing 55 and extending in the vertical direction.

The side plate 53 is a plate-shaped member positioned on a side close to a (third) casing 16 (in the present embodiment, a compressor inlet casing forming an inlet of the turbo chiller compressor 3C) attached to the other end of the casing 55 and extending in the vertical direction.

The side plate 54 is a plate-shaped member positioned on one end side (the near side on the plane of paper of FIG. 3) of the bottom plate 51, extending in the axial direction and the vertical direction, and having a rectangular shape as viewed in the plane. The not-shown side plate is a plate-shaped member positioned on the other end side (the far side on the plane of paper of FIG. 3) of the bottom plate 51, extending in the axial direction and the vertical direction, and having a rectangular shape as viewed in the plane.

A strip-shaped (sheet-shaped) (electric) heater 61 is attached so as to cover outer surfaces of the bottom plate 51, the side plate 54, and the not-shown side plate.

Strip-shaped (sheet-shaped) metal (e.g., SUS430) having a high coefficient of thermal conductivity (having excellent thermal conductivity) is interposed between the heater 61 and each of the outer surfaces of the bottom plate 51, the side plate 54, and the not-shown side plate, the metal closely adhering to all of the heater 61 and the outer surfaces of the plates.

According to the oil tank 50 of the turbo chiller compressor 3C of the present embodiment, i.e., the oil tank 50 of the turbo chiller compressor 3C including the heater 61, the heater 61 is replaced or checked only by detachment and attachment of the heater 61 attached to the outer surfaces of the bottom plate 51, the side plate 54, and the not-shown side plate.

Thus, the heater 61 can be replaced or checked without removing oil (not shown) from the oil tank 50 and removing refrigerant from the turbo chiller 1C.

Further, according to the oil tank 50 of the turbo chiller compressor 3C of the present embodiment, i.e., the oil tank 50 of the turbo chiller compressor 3C including the heater 61, the sheet-shaped metal (not shown) having a high coefficient of thermal conductivity is interposed between the heater 61 and each outer surface so as to closely adhere to all of the heater 61 and the outer surfaces. Thus, the coefficient of thermal conductivity from the heater 61 to an outer surface of the oil tank 50 can be increased, and therefore, a low-power heater can be employed.

According to the turbo chiller compressor 3C of the present embodiment, the heater 61 attached to the oil tank 50 can be replaced or checked without removing oil from the oil tank 50 and removing refrigerant from the turbo chiller 1C.

Moreover, according to the turbo chiller compressor 3C of the present embodiment, since the heater 61 attached to the oil tank 50 can be replaced or checked without removing oil from the oil tank 50 and removing refrigerant from the turbo chiller 1C, a working time required for replacement or checking of the heater 61 can be significantly reduced, and therefore, the operation rate and reliability of the turbo chiller compressor 3C can be improved.

In the turbo chiller 1C of the present embodiment, the working time required for replacement or checking of the heater 61 attached to the oil tank 50 of the turbo chiller compressor 3C is significantly reduced. Thus, the operation rate and reliability of the turbo chiller 1C can be improved.

{Fourth Embodiment}

An oil tank of a turbo chiller compressor of a fourth embodiment of the present invention, a turbo chiller compressor including the oil tank of the turbo chiller compressor of the fourth embodiment of the present invention, and a turbo chiller including the turbo chiller compressor of the fourth embodiment of the present invention will be described below with reference to FIG. 4.

Figure 4:
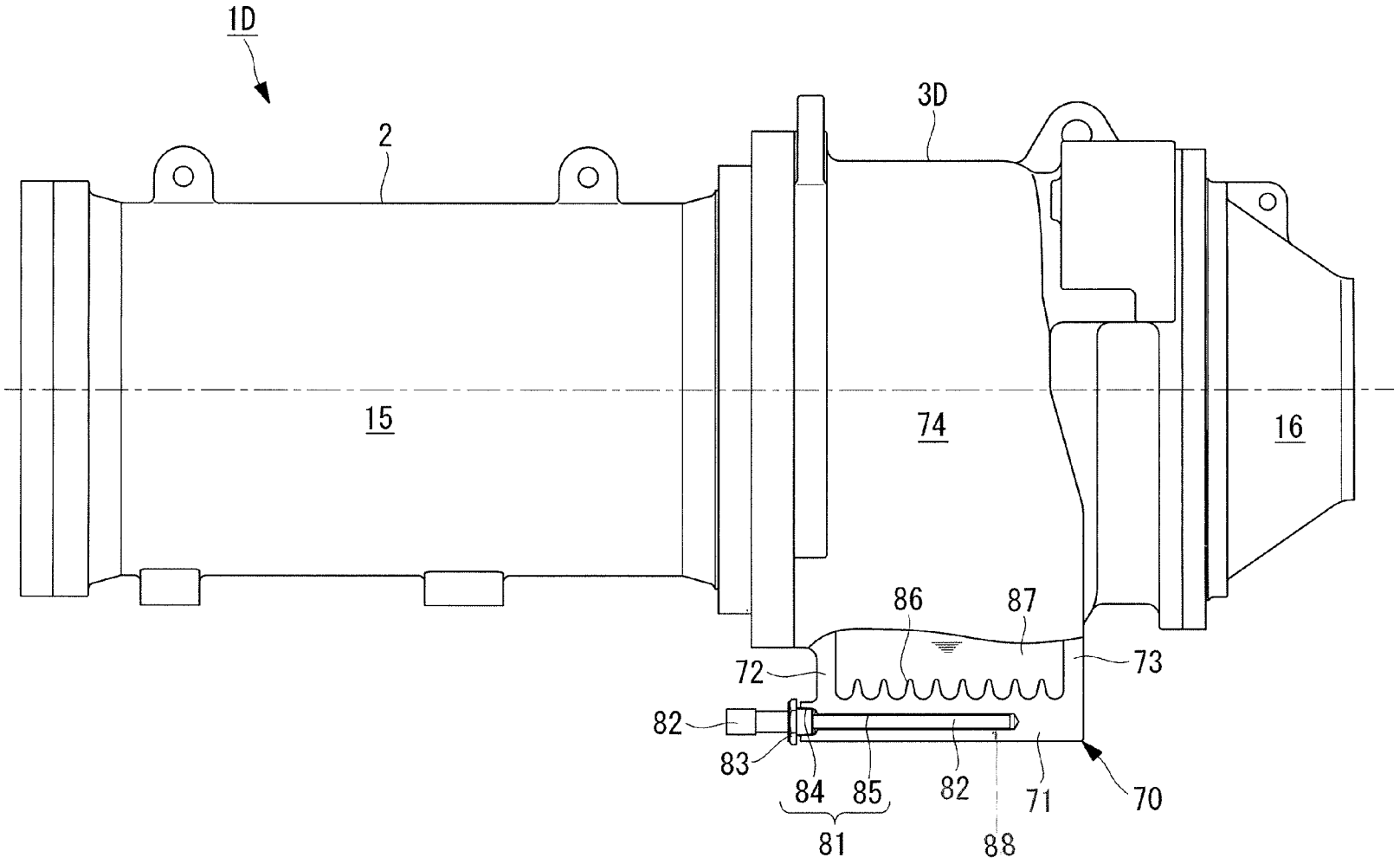
FIG. 4 is a partial cross-sectional view illustrating an oil tank of a turbo chiller compressor according to a fourth embodiment of the present invention.

As illustrated in FIG. 4, a turbo chiller 1D of the present embodiment is, for example, placed at a building or a factory in order to generate coolant water for adjusting air. The turbo chiller 1D includes a turbo chiller compressor (a turbo compressor) 3D rotatably driven by an electric motor 2 to compress refrigerant vapor into high-pressure vapor, an evaporator (not shown) configured to evaporate chilled water, a condenser (not shown) configured to cool high-pressure vapor with coolant water to condense the high-pressure vapor, and an expander (not shown) configured to expand, by reducing the pressure of condensed refrigerant, the condensed refrigerant to send the expanded refrigerant to the evaporator. The turbo chiller compressor 3D, the evaporator, the condenser, and the expander are connected together with refrigerant pipes (not shown) through which refrigerant circulates.

As illustrated in FIG. 4, an oil tank 70 of the turbo chiller compressor 3D of the present embodiment includes a bottom plate 71, a (first) side plate 72, a (second) side plate 73, a (third) side plate (not shown), and a (fourth) side plate (not shown), these side plates standing upright so as to extend upward from an outer peripheral edge portion of the bottom plate 71. These bottom and side plates form a bottom portion (a lower portion) of a (first) casing 74 (in the present embodiment, a compressor casing forming the turbo chiller compressor 3D).

The bottom plate 71 is a plate-shaped member extending in an axial direction and a right-left direction and having a rectangular shape as viewed in the plane.

The side plate 72 is a plate-shaped member positioned on a side close to a (second) casing 15 (in the present embodiment, a motor casing forming the electric motor 2) attached to one end of the casing 74 and extending in the vertical direction.

The side plate 73 is a plate-shaped member positioned on a side close to a (third) casing 16 (in the present embodiment, a compressor inlet casing forming an inlet of the turbo chiller compressor 3D) attached to the other end of the casing 74 and extending in the vertical direction.

In the bottom plate 71, a hole 81 is formed so as to extend, in the axial direction, from a vertically-extending end surface of the bottom plate 71 positioned on the side close to the casing 15 toward a vertically-extending end surface of the bottom plate 71 positioned on the side close to the casing 16.

The hole 81 is formed with a (first) hole 84 which is positioned on the near side (the side close to the casing 15) of the bottom plate 71 and which receives an external thread portion of a screw joint 83 provided at a base end portion of a rod-shaped (electric) heater (a heating means) 82 and a (second) hole 85 which is positioned on the far side (the far side of the hole 84) of the bottom plate 71 and into which the heater 82 is inserted.

An internal thread portion which comes into engagement with the external thread portion formed at an outer peripheral surface of the screw joint 83 is formed at an inner peripheral surface of the hole 84.

The heater 82 is inserted into the hole 81, and a space between the hole 81 and the heater 82 is filled with heat transfer fluid 88 (e.g., a heat-resistant release silicon material, chemically-synthesized oil, and a boron nitride aqueous solution) having a high coefficient of thermal conductivity (having excellent thermal conductivity).

A plurality of heat transfer fins 86 (in the present embodiment, eight heat transfer fins 86) having a corrugated shape as viewed in the cross section are formed at an upper surface (an internal surface) of the bottom plate 71. The heat transfer fins 86 are formed so as to protrude upward from the upper surface of the bottom plate 71, and continuously extend, in the vertical direction and the right-left direction, from an inner surface (an internal surface) of the (third) side plate (not shown) to an inner surface (an internal surface) of the (fourth) side plate (not shown).

Note that a reference numeral "87" in FIG. 4 denotes oil (lubrication oil).

According to the oil tank 70 of the turbo chiller compressor 3D of the present embodiment, i.e., the oil tank 70 of the turbo chiller compressor 3D including the heater 82, the plurality of heat transfer fins 86 are formed so as to protrude upward from the upper surface of the bottom plate 71, and therefore, the contact area between the oil 87 and the bottom plate 71 heated by the heater 82 can be increased. Thus, the oil 87 can be more efficiently heated, and as a result, a lower-power heater can be employed.

Since other functions and advantageous effects are the same as those of the second embodiment described above, the description thereof is omitted.

Note that the present invention is not limited to the above-described embodiments, and modifications and changes can be optionally made as necessary.

For example, in the above-described first embodiment, the space between the protective tube 22 and the heater 26 is filled with the heat transfer fluid 88 having a high coefficient of thermal conductivity. However, this heat transfer fluid 88 is not essential.

In the above-described second embodiment, the space between the hole 41 and the heater 42 is filled with the heat transfer fluid 88 having a high coefficient of thermal conductivity. However, this heat transfer fluid 88 is not essential.

Moreover, in the above-described third embodiment, the strip-shaped metal having a high coefficient of thermal conductivity is interposed between the heater 61 and each of the outer surfaces of the bottom plate 51, the side plate 54, and the not-shown side plate so as to closely adhere to all of the heater 61 and the outer surfaces. However, this metal is not essential.

Further, in the above-described third embodiment, the configuration in which the heater 61 is attached so as to cover the outer surfaces of the bottom plate 51, the side plate 54, and the not-shown side plate has been described as one specific example. However, the present invention is not limited to this example, and the heater can be attached so as to only cover the outer surface of the bottom plate 51.

In addition, in the above-described fourth embodiment, combination of the second embodiment and the fins 86 has been described as one embodiment. However, the present invention is not limited to this configuration, and the third embodiment and the fins 86 can be combined together.

Moreover, in above-described second, third, and fourth embodiments, there is a probability that the temperature of the bottom and side plates is high. Thus, a (first) thermometer configured to measure an oil temperature and a (second) thermometer configured to measure an oil tank temperature are more preferably provided to monitor both of the oil temperature and the oil tank temperature, thereby turning on/off the heater.

This can prevent the temperature of the oil tank which might be touched by the hand(s) of a person from excessively increasing, and as a result, safety can be improved.

Further, a heat-retaining material is more preferably provided so as to cover the entirety of the outer portion of the oil tank in above-described first, second, and fourth embodiments and to cover the entirety of the outer portions of the oil tank and the heater in the third embodiment.

This can reduce the amount of heat dissipation to increase heat-retaining properties. Thus, power consumption of the heater can be reduced, and as a result, a running cost can be reduced.

In addition, in above-described second and fourth embodiments, the heaters 42, 82 are more preferably formed of four heaters each having a capacity of 500 W (having a total capacity of 2000 W).

Thus, for example, when the temperature of the oil tanks 30, 70 is equal to or lower than 30° C., all of the four heaters can be used to heat the oil tanks 30, 70. When the temperature of the oil tanks 30, 70 is higher than 30° C. and lower than 50° C., three of the four heaters can be used to heat the oil tanks 30, 70. When the temperature of the oil tanks 30, 70 is equal to or higher than 50° C., two of the four heaters can be used to heat the oil tanks 30, 70.

That is, under the conditions with a spare oil heating time, i.e., the conditions where the temperature of the oil tanks 30, 70 is high, the amount of heating of the oil tanks 30, 70 by the heaters 42, 82 can be reduced, and as a result, the amount of heat dissipation to the surrounding atmosphere can be reduced.

REFERENCE SIGNS LIST

1A turbo chiller
1B turbo chiller
1C turbo chiller
1D turbo chiller
3A turbo chiller compressor
3B turbo chiller compressor
3C turbo chiller compressor
3D turbo chiller compressor
10 oil tank
11 bottom plate
12 side plate
13 side plate
14 casing
21 through-hole
22 protective tube
26 heater
30 oil tank
31 bottom plate
32 side plate
33 side plate
34 casing
41 hole
42 heater
50 oil tank
51 bottom plate
52 side plate
53 side plate
54 side plate
55 casing
61 heater
70 oil tank
71 bottom plate
72 side plate
73 side plate
74 casing
81 hole
82 heater

The invention claimed is:

1. An oil tank of a turbo chiller compressor, comprising:
a bottom plate; and
a side plate standing upright so as to extend upward from an outer peripheral edge portion of the bottom plate,
the oil tank forming a bottom portion of a casing forming the turbo chiller compressor, wherein
in the bottom plate, a hole is formed so as to extend from one end surface of the bottom plate toward the other end surface of the bottom plate opposite to the one end surface,
a rod-shaped heater configured to be able to be pulled out from the hole and be inserted into the hole is inserted into the hole, and
a plurality of identical heat transfer fins are formed so as to protrude upward from an entire upper surface of the bottom plate.

2. The oil tank of a turbo chiller compressor according to claim 1, wherein
a space between the hole and the heater is filled with a heat-resistant release silicon material, chemically-synthesized oil, or a boron nitride aqueous solution.

3. A turbo chiller compressor comprising:
the oil tank of a turbo chiller compressor according to claim 1.

4. A turbo chiller comprising:
the turbo chiller compressor according to claim 3.

* * * * *